US006769593B2

(12) United States Patent
Pedicini et al.

(10) Patent No.: US 6,769,593 B2
(45) Date of Patent: Aug. 3, 2004

(54) SYNCHRONOUS DRIVE PIN CLUTCH

(75) Inventors: Christopher S. Pedicini, Roswell, GA (US); John D. Witzigreuter, Kennesaw, GA (US)

(73) Assignee: Tricord Solutions, Inc., Roswell, GA (US)

( * ) Notice: Subject to any disclaimer, the term of this patent is extended or adjusted under 35 U.S.C. 154(b) by 0 days.

(21) Appl. No.: 10/427,228

(22) Filed: May 1, 2003

(65) Prior Publication Data

US 2003/0192934 A1 Oct. 16, 2003

Related U.S. Application Data

(62) Division of application No. 10/091,410, filed on Mar. 7, 2002, now Pat. No. 6,604,666.

(60) Provisional application No. 60/313,618, filed on Aug. 20, 2001.

(51) Int. Cl.[7] ..... B25C 1/06

(52) U.S. Cl. ..... 227/131; 227/2; 173/124; 173/178; 173/205

(58) Field of Search ..... 227/131, 2, 132; 173/124, 205, 176, 178, 216, 217

(56) References Cited

U.S. PATENT DOCUMENTS

| | | | | | |
|---|---|---|---|---|---|
| 4,204,622 | A | * | 5/1980 | Smith et al. | 227/7 |
| 4,530,454 | A | * | 7/1985 | Gloor et al. | 227/129 |
| 4,640,452 | A | * | 2/1987 | Matt et al. | 227/131 |
| 4,928,868 | A | * | 5/1990 | Kerrigan | 227/131 |
| 4,953,774 | A | * | 9/1990 | Lai | 227/131 |
| 5,098,004 | A | * | 3/1992 | Kerrigan | 227/134 |
| 5,320,270 | A | * | 6/1994 | Crutcher | 227/131 |
| 5,495,161 | A | * | 2/1996 | Hunter | 318/807 |
| 5,511,715 | A | * | 4/1996 | Crutcher et al. | 227/131 |
| 5,927,585 | A | * | 7/1999 | Moorman et al. | 227/132 |

* cited by examiner

*Primary Examiner*—Scott A. Smith
(74) *Attorney, Agent, or Firm*—Moore Ingram Johnson & Steele, LLP; Jonathan H. Petcu

(57) ABSTRACT

This invention relates to the design of a pin clutch to allow for coupling of a rotational shaft to an output mechanism in a synchronous fashion. Specifically, this is related to impacting or operations requiring intermittent or semi-intermittent coupling of an input mechanism or shaft to an output mechanism or shaft. Devices of this nature include fastening tools, throwing mechanisms and other devices in which input energy is built up during a portion of a cycle followed by the coupling and release of that energy to an output mechanism.

14 Claims, 4 Drawing Sheets

SYNCHRONOUS DRIVE PIN CLUTCH

CROSS-REFERENCE TO RELATED APPLICATIONS

This application is a divisional application of U.S. patent application Ser. No. 10/091,410 filed on Mar. 7, 2002, now U.S. Pat. No. 6,604,666, which is the nonprovisional utility application claiming priority from provisional application No. 60/313,618, filed on Aug. 20, 2001.

STATEMENT REGARDING FEDERALLY SPONSORED RESEARCH OR DEVELOPMENT

Not Applicable.

REFERENCE TO SEQUENCE LISTING, A TABLE, OR A COMPUTER LISTING COMPACT DISK APPENDIX

Not Applicable.

BACKGROUND OF INVENTION

This application is the divisional application of patent application Ser. No. 10/091,410 and the material contained in the parent application is hereby incorporated herein by this specific reference. This invention relates to the design of a pin clutch to allow for coupling of a rotational shaft to an output mechanism in a synchronous fashion. Specifically, this is related to impacting or operations requiring intermittent or semi-intermittent coupling of an input mechanism or shaft to an output mechanism or shaft. Devices of this nature include fastening tools, throwing mechanisms and other devices in which input energy is built up during a portion of a cycle followed by the coupling and release of that energy to an output mechanism. This invention relates generally to portable electromechanical devices. Such devices are typically less than 30 pounds and are completely suitable for an entirely portable operation.

Devices often are required to couple an input shaft to an output mechanism in a fashion which allows for a high transfer of energy over a limited output period. The nature of direct coupling allows for a quick, efficient and robust energy or motion transfer. Such applications can include throwing devices such as pitching mechanisms, impacting mechanisms such as nailers, staplers, riveters and cutting operations which require a swift cutting action to avoid damage to substrates.

The most common type clutches used for these types of devices are based on frictional or complicated electromechanical means such as a pin shifting by means of a solenoid.

All of the currently available devices suffer from a number of disadvantages that include:

1. Complex design. Frictional engagements often have many close tolerance parts that require complex assembly. Additionally, since the transfer is by frictional means, the normal force required between the plates is often very large. Mechanical clutches with pins are often shifted by solenoids or other electrical means adding to the complexity of the design. Additionally, for high-speed engagement, timing elements must be included to enable repeatable action.
2. High Output Inertia to Size Ratio. Frictional clutches require large surfaces to enable a long lasting design. These larger surface requirements increase the output inertia and size of the clutch for a given amount of energy transfer.

3. Wear. Frictional clutches have wear items in the form of the friction plates. These friction plates by design have a limited life. Direct acting clutches often have the engagement parts running at large relative speeds which contributes to wear. Pin clutches in which the pin rides on a stationary activation plate wear excessively at high speeds since the relative speed of the pin to the actuation plate is high.
4. Complex operation. Currently available pin clutches which operate on solenoids to move a pin in and out of engagement or a camming means to move a pin in and out of engagement suffer from a complicated design. The timing must be accurately controlled leading to increased cost. Additionally, for rapidly rotating clutching mechanisms, the timing becomes quite critical.
5. Difficult to control. Often these types of clutches will require sensing means to determine the position of the various elements in order to engage and disengage the input shaft from the output mechanism.

BRIEF SUMMARY OF THE INVENTION

In accordance with the present invention, a pin clutch is described which allows for synchronous clutching of energy or motion between an input shaft and an output shaft or mechanism. It is especially suitable for intermittent operations in which the typical cycle begins with the input shaft starting from a rest point, movement for a certain period, engaging the output mechanism, disengaging the output mechanism and then the input coming back to a resting condition. For example, the input shaft is accelerated from a known state and, within a prescribed amount of rotation, allows for transfer of energy to an output device for a certain period of rotation. This invention permits a completely mechanical setup to control a time period for building up energy on the input side of the pin clutch and then a positive transfer of motion or energy to the output device. The clutch disengagement is purely by mechanical means either by spring return or a positive acting lobe on a cam surface thus disengaging the inputs and outputs. Often in intermittent mechanisms, this could be followed up with either another acceleration period to store more energy on the input side or a brake and possible stopping of the input shaft. The cycle is repeated in a synchronous fashion as controlled by the selection of the various inputs associated with the design of this clutch.

Accordingly, in addition to the objects and advantages of the synchronous pin clutch as described above, several objects and advantages of the present invention are:

1. To provide a clutching element which engages and disengages in a synchronous fashion.
2. To provide a clutching element which permits robust engagement and disengagement of an input and output in a repeatable fashion.
3. To provide a clutching mechanism which does not have frictional elements that are subject to wear when coupling high inertia loads.
4. To provide a clutching mechanism which has a very high power transfer to size ratio.
5. To provide a clutching mechanisms which has compliance during engagement positions thus reducing impact stresses.
6. To provide a clutching mechanism which is especially suitable for intermittent operations in which the input shaft is cycled and comes back to a resting state.
7. To provide a clutching mechanism which is very inexpensive and simple.

Further objects and advantages will become more apparent from a consideration of the ensuing description and drawings.

REFERENCE NUMBERS IN DRAWINGS

1 Input Shaft
2 Cam Gear Pinion
3 Drive Gear Pinion
4 Cam Gear
5 Drive Gear
6 Face Cam
7 Shiftable Clutch Pin
8 Clutch Pin Return Spring
9 Output Mechanism
10 Barrel Cam
11 Fastener Driving Device Embodiment
12 Synchronous Drive Pin Clutch

DETAILED DESCRIPTION OF THE INVENTION

The operation of the invention in coupling applications of high energy has significant improvements over that which has been described in the art. The clutch allows for energy transfer by direct means using a shiftable pin. This avoids the frictional losses and the wear issues associated with friction clutches. In addition, the clutch avoids the wear issues of other pin clutches in that the drive pin is rotating within the mechanism at speeds that are typically far lower than the speed of the input shaft. This decreases the wear and frictional losses associated with the drive pin wearing on a stationary camming plate and increases the robustness by allowing a gradual movement in and out of the clutch pin in relation to the camming surface. This decreases the impact load on the clutch pin from such scenarios and increases the robustness of operation. The clutch pin is a substantially rigid pin which moves from an engagement position to a disengagement position. The shape of the pin is irrelevant and can be rectangular, polygonal or circular. Additionally, the pin can be cammed either parallel or perpendicular to the drive gear axis to engage the output mechanism. For a parallel engagement, a standard barrel cam (or face cam) is used. For a perpendicular engagement, a plate cam or similar mechanical element could be used. Furthermore, it is possible to have more than one camming surface and one pin within this style of clutch. Following the engagement of the input and output thru the synchronous clutch, the pin is returned to its starting position via additional camming means, a spring return, or other biasing technique. The engagement and disengagement of shiftable clutch pin constitute a cycle.

PREFERRED EMBODIMENT OF THE DESIGN

FIGS. 1–4 represent both descriptions of the preferred embodiment of the clutch as well as one application. The operations of the clutch as depicted are described from an intermittent standpoint, but could well apply to motions of a semi-intermittent nature. Additionally, various different mechanical elements may be changed without departing from the spirit of the invention. For example, the synchronous elements of this clutch are described as gears but could be any elements which maintain synchronism with each other such as timing pulleys, chains, etc. Furthermore, we refer to a cam pinion and a drive pinion as distinct elements in the preferred embodiment. In reality, these elements turn in unison and could be one common pinion.

Figure 1:
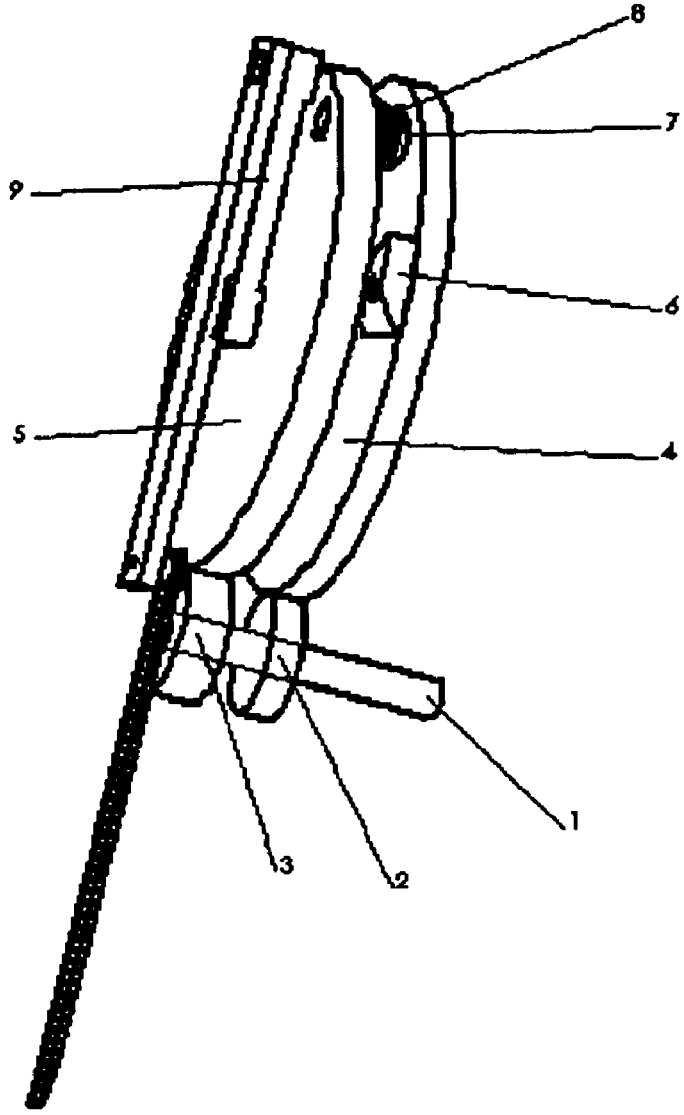
FIG. 1 is an isometric overview of the clutching mechanism.
Figure 2:
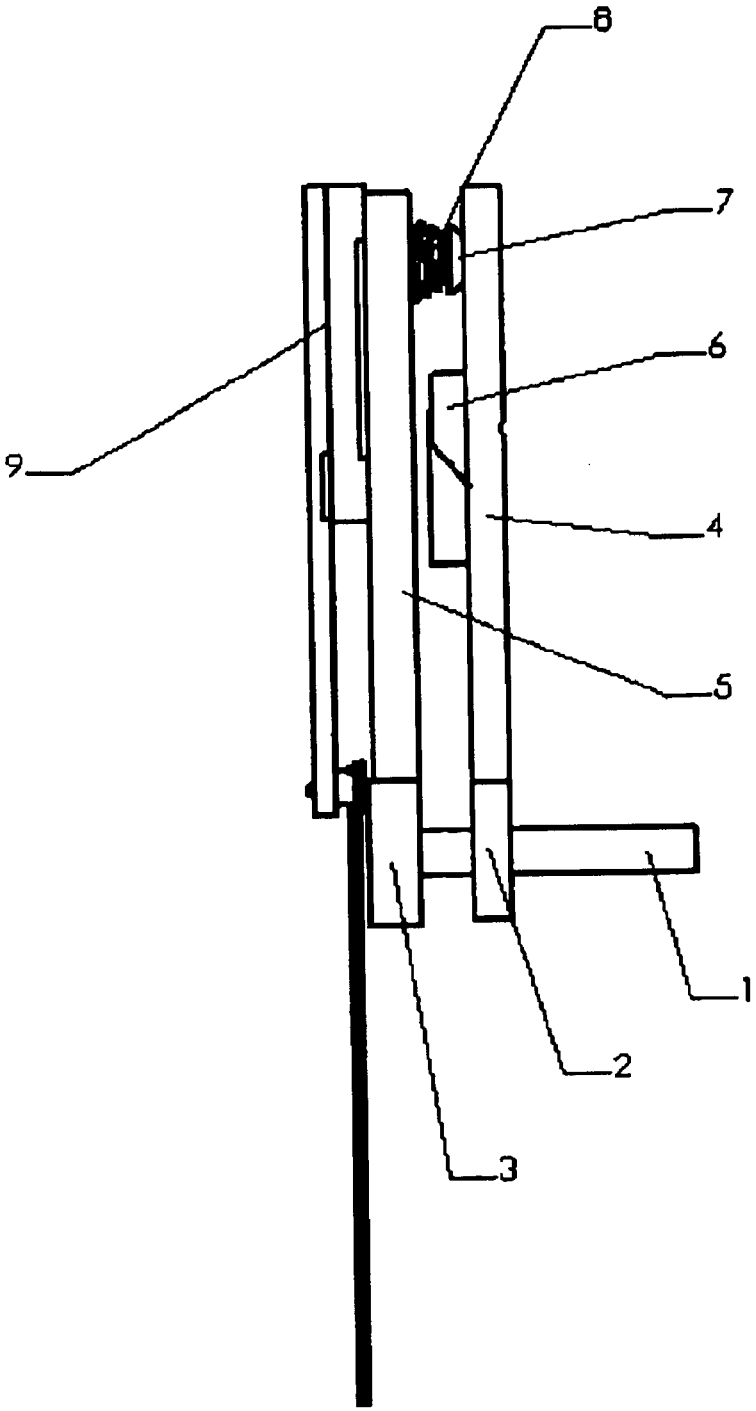
FIG. 2 is a side view of the clutching mechanism.

During operation, the input shaft (1) drives both the cam gear (4) and the drive gear (5) through the drive gear pinion (3) and the cam gear pinion (2) respectively. The applied power to the input shaft (1) causes the drive gear (5) and the cam gear (4) to rotate. The ratio of the cam gear (4) and the cam gear pinion (2) in relation to the ratio of the drive gear pinion (3) and the drive gear (5) are not the same. The ratios in this example are 4:1 (for the cam gear) and 4.33:1 (for the drive gear), but any ratios which maintain an unequal synchronous ratio could be used. The ratio for the cam gear can be larger or smaller than the drive gear ration. In this example, for each 52 inputs of the input shaft (1) the drive gear (5) would rotate 12 turns and the cam gear (4) would rotate 13 turns. As long as the ratios are chosen such that for an integral number of input turns, the output turns of the cam gear (4) and the drive gear (5) differ by one turn, the synchronous clutch will reset its timing. For example, a choice of 3:1 and 3.5:1 would give a total of 6 to 7 turns for either the cam gear or the drive depending on the ratio associated for 21 turns of the input shaft. The turning of the input shaft (1) initiates relative motion between the cam gear (4) and the drive gear (5) i.e. the cam gear and the drive gear are rotating at different speeds. Referring now to FIG. 1, the face cam (6) is connected to the cam gear (4) and rotates with same. As the cam gear (4) and the drive gear (5) rotate the relative motion between the two causes the face cam (6) to approach the shiftable clutch pin (7). The shiftable clutch pin (7) is preferably located through a hole in the drive gear (5) and is forced against the cam gear (4) by the clutch pin return spring (8). The gear ratio differential between the drive gear (5) and the cam gear (4) is such that the drive gear (5) makes from 1–100 revolutions, the preferred number of revolutions being in the range of 8 to 40, before the face cam (6) engages the shiftable clutch pin (7). As the face cam (6) initiates contact with the shiftable clutch pin (7), the shiftable clutch pin (7) compresses the clutch pin return spring (8) and protrudes through the face of the drive gear (5). As the drive gear (5) rotates with the shiftable clutch pin (7) extended, the shiftable clutch pin (7) engages the output mechanism (9). The output mechanism (9) is now coupled directly to the input shaft (1) and will rotate as a result. In the preferred design, the output may have some compliance in order to minimize potential impact of the shiftable clutch pin (7) to the output mechanism (9). Additionally, it is possible to put a certain amount of compliance into the input side to allow for a gradual transmission of the input energy to the output mechanism (9). The output mechanism (9) then rotates in unison with the drive gear (5) as long as the shiftable clutch pin (7) remains extended. After additional rotational input of the input shaft (1) the face cam (6) has moved far enough relative to the shiftable clutch pin (7), that the clutch pin return spring (8) can force the shiftable clutch pin (7) back to its return position against the cam gear (4) and disengage the output mechanism (9). This disengagement period can occur anywhere within the drive period and can be optimized for the application. Once the disengagement occurs, the cycle is complete and can be repeated on an intermittent or continuous basis. Variations such as the use of a multiple face cams and multiple shiftable clutch pins are possible without departing from the spirit of the invention. In addition, it may be advantageous in certain designs to use a separate molded cam which is attached to the cam gear or an output bar which contains the clutch pin and is attached to the drive gear.

Figure 3:
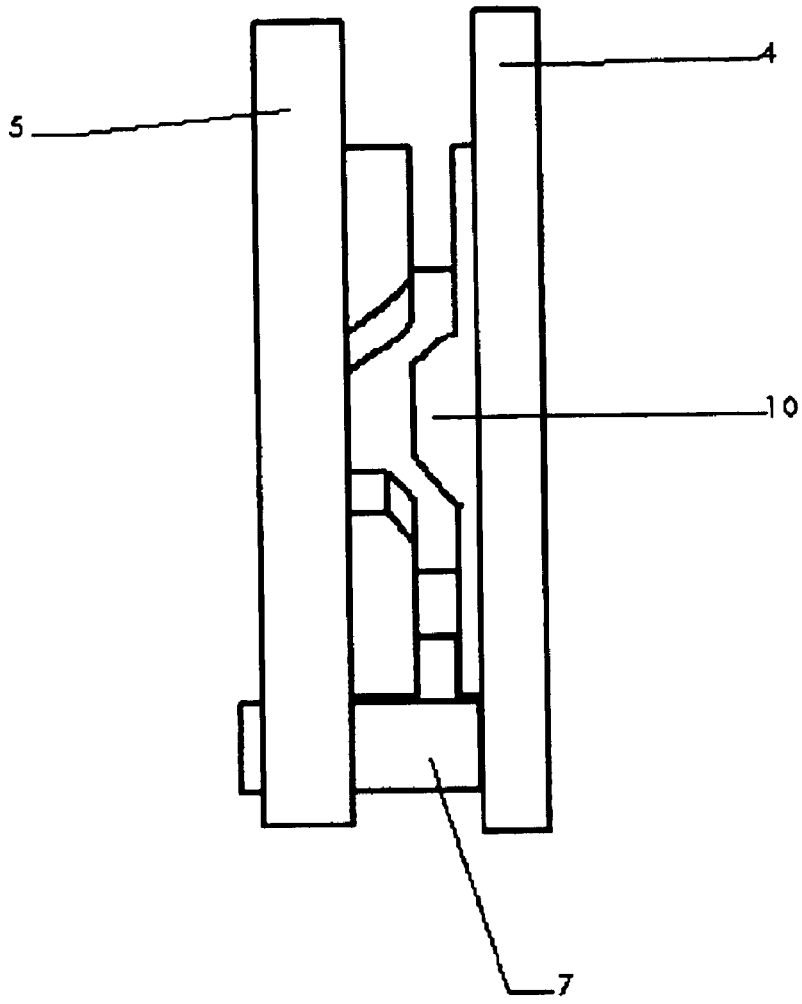
FIG. 3 is a top view of a clutching mechanism that utilizes a barrel cam to move the shiftable clutch pin.

Another modification is possible as shown in FIG. 3. In this case, the face cam (6) is replaced with a positive acting barrel cam (10). This allows for both positive advance and retraction of the shiftable clutch pin (7) and removes the need for the clutch pin return spring (8).

Figure 4:
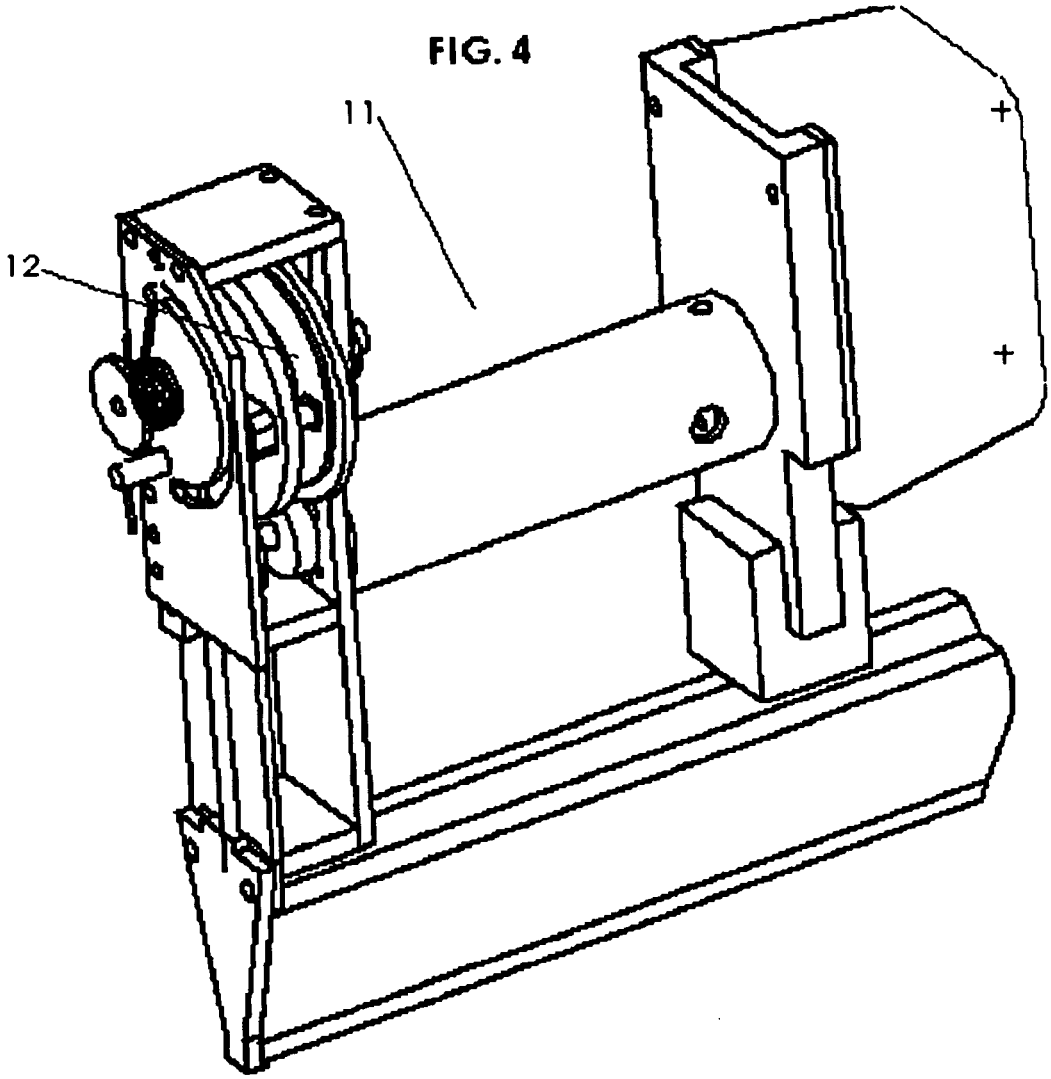
FIG. 4 is an isometric view of the clutching mechanism in a practical application of a fastener driving tool.

The uses for such a repeatable clutch are many and varied. Some possible uses include engagement and transfer of input energy to an output on a demand case. These could include pitching machines of many types. Impacting applications such as fastener driving devices are good applications for such a clutch. One such example is shown in FIG. 4. In this particular example, the cam gear has an integral cam attached to it to more accurately control the clutch pin motion and the drive gear has an output bar integrally attached to it which contains the clutch pin. Other possible uses include transferring energy from the input to the output for tree or limb trimming applications. This type of mechanism has the potential to transfer a high peak force from the input to the output without having to use complex gearing. A further potential use of this style of clutch is to allow delivery of a high pressure pulse of a fluid such as air. In this application, the output of the clutch could be coupled to a simple slider crank piston mechanism. The input could be a motor driven kinetic energy storage device such as a flywheel. Upon actuation, the motor would spin up storing energy kinetically which could be transferred by this clutch in a very efficient manner over an approximate 180 degree drive cycle. This can result in a high pressure pulse which could be used in number of different applications. Although we have described several potential uses, it should be understood that we are not limiting the clutch to only the aforementioned devices.

It will be understood various changes in details, materials, arrangements or parts and operating conditions which have been herein described and illustrated in order to explain the nature of the invention may be made by those skilled in the art within the principles and scope of the invention.

We claim:

1. A synchronous clutch comprised of:

an input shaft;

a cam pinion connected to said input shaft, wherein said cam pinion rotates with said input shaft;

a drive pinion connected to said input shaft, wherein said drive pinion rotates with said input shaft;

a cam gear coupled to said cam pinion;

a drive gear coupled to said drive pinion wherein said cam gear rotates at a different speed than said drive gear;

a camming means connected to and rotating with said cam gear;

a shiftable clutch pin connected to said drive gear, wherein said shiftable clutch pin rotates with said drive gear and wherein said shiftable clutch pin moves in response to said camming means; and an output mechanism, wherein said shiftable clutch pin engages said output mechanism at some point during the rotation of the shiftable clutch pin.

2. The synchronous clutch according to claim 1, wherein the cam gear rotates at a different speed than said drive gear, but at ratios which repeat on a synchronous basis of between 1 and 100 revolutions of the drive gear.

3. The synchronous clutch according to claim 1, wherein the shiftable clutch pin further moves in one direction in response to a biasing element.

4. The synchronous clutch according to claim 3, wherein the cam gear rotates at a different speed than said drive gear, but at ratios which repeat on a synchronous basis of between 1 and 100 revolutions of the drive gear.

5. The synchronous clutch according to claim 1, 2, 3 or 4, wherein the shiftable clutch pin moves parallel to the axis of the drive gear.

6. The synchronous clutch according to claim 1, 2, 3 or 4, wherein the shiftable clutch pin moves perpendicular to the axis of the drive gear.

7. The synchronous clutch according to claim 1, 2, 3 or 4, wherein the synchronous clutch is used within a portable hand tool.

8. The synchronous clutch according to claim 1, 2, 3 or 4, wherein the synchronous clutch is used for applications of an intermittent nature.

9. The synchronous clutch according to claim 1, 2, 3 or 4, wherein the shiftable clutch pin is further stabilized by a clutch pin return spring.

10. The synchronous clutch according to claim 1, 2, 3 or 4, wherein the camming means is replaced with a positive acting barrel cam.

11. A synchronous clutch comprised of:

an input shaft;

a pinion connected to said input shaft, wherein said pinion rotates with said input shaft;

a cam gear coupled to said pinion;

a drive gear coupled to said pinion wherein said cam gear rotates at a different speed than said drive gear;

a camming means connected to and rotating with said cam gear;

a shiftable clutch pin connected to said drive gear, wherein said shiftable clutch pin rotates with said drive gear and wherein said shiftable clutch pin moves in response to said camming means; and an output mechanism, wherein said shiftable clutch pin engages said output mechanism at some point during the rotation of the shiftable clutch pin.

12. The synchronous clutch according to claim 11, wherein the cam gear rotates at a different speed than said drive gear, but at ratios which repeat on a synchronous basis of between 1 and 100 revolutions of the drive gear.

13. The synchronous clutch according to claim 11, wherein the shiftable clutch pin further moves in the return direction in response to a biasing element.

14. The synchronous clutch according to claim 13, wherein the cam gear rotates at a different speed than said drive gear, but at ratios which repeat on a synchronous basis of between 1 and 100 revolutions of the drive gear.

* * * * *